United States Patent [19]

Wittrisch

[11] Patent Number: 4,898,241

[45] Date of Patent: Feb. 6, 1990

[54] METHOD AND DEVICE FOR TAKING MEASUREMENTS AND/OR CARRYING OUT INTERVENTIONS IN A WELL SUBJECTED TO HYDRAULIC COMPRESSION

[75] Inventor: Christian Wittrisch, Rueil Malmaison, France

[73] Assignee: Institut Francais du Petrole, Rueil Malmaison, France

[21] Appl. No.: 251,702

[22] PCT Filed: Dec. 30, 1987

[86] PCT No.: PCT/FR87/00521

§ 371 Date: Aug. 31, 1988

§ 102(e) Date: Aug. 31, 1988

[87] PCT Pub. No.: WO88/05110

PCT Pub. Date: Jul. 14, 1988

[30] Foreign Application Priority Data

Dec. 31, 1986 [FR] France ..... 86 18414
Dec. 31, 1986 [FR] France ..... 86 18417

[51] Int. Cl.[4] ..... E21B 34/14; E21B 47/00

[52] U.S. Cl. ..... 166/250; 166/66; 166/385; 166/386; 166/308

[58] Field of Search ..... 166/250, 316, 254, 332, 166/255, 252, 386, 381, 308, 382, 385, 387, 64, 65.1, 66, 69, 72, 77; 175/40, 45, 50, 61, 62, 104, 317, 318

[56] References Cited

U.S. PATENT DOCUMENTS 4,108,243 8/1978 King et al. ..... 166/66
4,553,599 11/1985 Glotin ..... 166/332
4,690,214 9/1987 Wittrisch ..... 166/250

FOREIGN PATENT DOCUMENTS 0077275 4/1983 European Pat. Off. .
2564894 11/1985 France .

*Primary Examiner*—Bruce M. Kisliuk
*Attorney, Agent, or Firm*—Antonelli, Terry & Wands

[57] ABSTRACT

A method and device for taking measurements and/or carrying out interventions in a well comprising a first zone wherein hydraulic compression including for providing hydraulic fracturing is achieved and a second zone wherein measurements and/or interventions are carried out, said compression zone communicating through a casing to hydraulic pressure means, the lower end of the casing comprising an assembly of one or the plurality of measuring instruments connected to the surface via cable placed inside the casing and mechanically isolated from the casing by an elastic link. In the method, at a point in the casing adjacent to the fracturing zone, any fracturing fluid flow coming from or going to said fracturing zone is controlled by a control element actuated at least partially by the cable from the surface, the control element being situated at a level higher than the assembly. The device includes means which control the fluid circulation between the casing and the compression zone and the cable is adapted to control the means from the surface.

13 Claims, 5 Drawing Sheets

Figure 1:
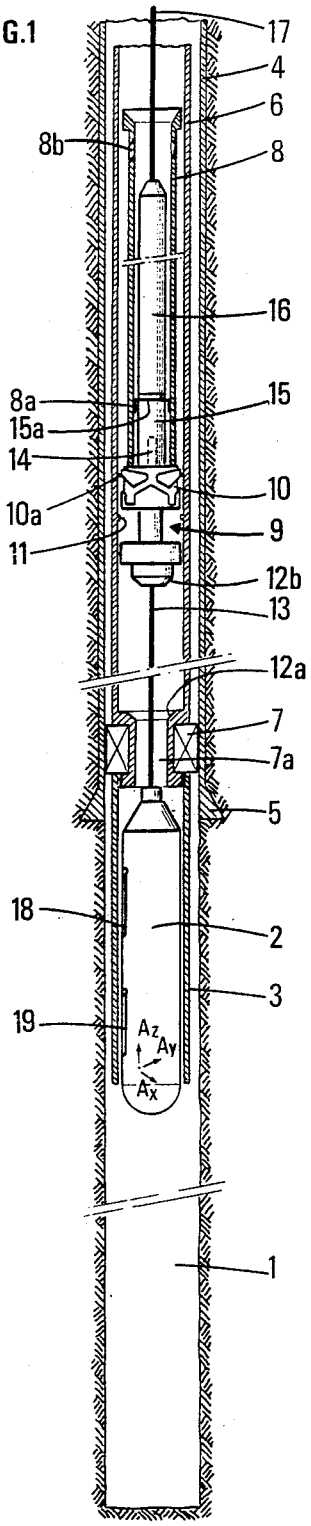

METHOD AND DEVICE FOR TAKING MEASUREMENTS AND/OR CARRYING OUT INTERVENTIONS IN A WELL SUBJECTED TO HYDRAULIC COMPRESSION

The present invention relates to a method and a device allowing measurements and/or interventions to be made in a well at the level of the surrounding formations, in particular of formations subjected to hydraulic compression. The invention applies in particular when measurements are to be taken and/or interventions carried out at the level of geologic formations located in a first zone which is to be isolated from the rest of the well when a hydraulic fluid is injected under pressure into a second zone in order to fracture the formations (hydraulic fracturing process).

Previous hydraulic fracturing techniques have been described for example in U.S. Pat. No. 3,427,652.

The measures taken in practicing the present invention may, for example, include triaxial recording of sounds produced by the rocks stressed in this manner. Analysis of vibrations detected allows the orientation of the sound source and hence the direction of propagation of the fracture to be defined. This analysis technique is well known to geophysicists and will not be described here in greater detail.

Techniques in the prior art for determining the propagation of fractures in the ground are described, for example, in U.S. Pat. Nos. 3,739,871 and 3,775,739.

The measurements made may also include recording the pressure and temperature at the bottom and measurement (focused or unfocused) of the electrical resistivity of the formations and listening to and recording sounds created by the flow of fluids produced by the geological formations.

These measurements may be supplemented by viewing the well walls with a television canera, for example.

One of the purposes of the invention is to supply a device and a method for preventing fluid, supplying a zone of the well subjected to hydraulic compression, from leaking out of the pressurized casing and influencing themeasurements made particularly in this compression zone.

In one embodiment, the invention in particular allows a set of one or more measuring and/or intervention instruments to be moved, particularly in the well zone subjected to compression, in order to put them in position.

The invention also allows a set of instruments placed at the lower end of the casing to be protected from external mechanical action when they are lowered into the well toward the compression zone.

In another embodiment, the invention permits a compression zone with good hydraulic isolation in which measurements may be made, and permits another non-compressed zone, outside and below the latter, in which measurements and/or interventions are made.

French Pat. No. FR-2,544,013 teaches a device and a method for carrying out measurements and/or inteventions in a well or in a zone of the well subjected to hydraulic compression. However, this prior solution, which allowed a set of instruments to be positioned before or during hydraulic compresion and which ensured protection of the instrument set while it was being positioned, is particularly sensitive to fluid leaks in the casing.

The measurements and/or interventions are carried out with a set of instruments connected to the surface by a cable.

The invention furnishes a method for carrying out measurements and/or interventions in a well having a first zone where hydraulic compression is effected, such as hydraulic fracturing, and a second zone where the measurements and/or interventions are carried out.

In this method, a set of one or more measuring and/or intervention instruments is introduced into the well at the lower end of a casing, with the compression zone being connected by the casing to hydraulic pressurization means, the set being connected to the surface by a cable located inside the casing and mechanically uncoupled from the casing by an elastic link such as a link cable. The method is particularly characterized by the control, at a point in the casing close to the fracturing zone, of all flows of fracturing fluid coming from or going to the fracturing zone, by means of a control element commanded at least partially by the cable from the surface, the control element being located at a higher level than said set.

When the first compression zone and the second measuring and/or intervention zone are the same zone and are disposed at the lower end of the casing, the control element may have a stopper integral with the cable connected to the surface and a seat integral with the casing, with the stopper cooperating with the seat to ensure flow and non-flow of the fluid through the element; when there is a controlled pull on the stopper by means of the cable, fluid is allowed to circulate through said element.

When the first compression zone and the second measuring and/or intervention zone are the same zone and are disposed at the lower end of the casing, the control element may have a stopper integral with the cable connected to the surface and a seat integral with the casing, with the stopper cooperating with the seat to ensure flow and absence of flow of the fluid through the element; when there is a controlled pull on the stopper by means of the cable, fluid is allowed to circulate through the control element.

When the first compression zone is isolated from said second measuring and/or intervention zone and is located between the lower end and the surface, the cable end may have a base, translationally movable and connected to the set by a shaft; the shaft may cooperate with isolation means integral with the casing to prevent the fluid contained in the casing from escaping therefrom through the lower end of the casing; the control element may have a stopper integral with the base or the shaft cooperating with a seat integral with the casing, and the base may be moved, by means of the cable, to maneuver the control element.

The control element may be kept in a position preventing all fluid from circulating by creating a controlled pressure differential between the casing and the zone to be fractured, or on both sides of said control element.

The cable may have at least one electric conductor and the end of the cable may have a connecting element connected to the line and designed to cooperate with an additional connecting element, integral with the base when the cable end is anchored to the base, the additional connecting element being connected by at least one electric conductor to said set of instruments and/or said control element.

The set of instruments can be moved relative to the casing by means of the cable.

To carry out the measurements and/or interventions, the method may comprise the following steps (a) the casing is placed in the well,
(b) the set of instruments is anchored to the well measuring and/or intervention zone,
(c) the elastic link is slackened,
(d) a hydraulic pressure is produced in the compression zone and
(e) the control element is stoppered.

When the stopper permits all circulation of fluid when a controlled pull is exerted on the cable connected to the surface and when the seat has a sufficient cross section to allow the set of instruments to pass through it, the method according to the invention may comprise the following steps:

(f) the casing is placed in the well,
(g) the instrument set is slid into the casing,
(h) the instrument set is anchored in the well at the level of the zone to be fractured,
(i) the connecting cable is slackened,
(j) a hydraulic pressure is produced in the fracturing zone such as to ensure fracturing, and
(k) the control element is stoppered.

The lower end of the cable may have holding means such as an anchoring system designed to cooperate with holding elements integral with a base or support part, the base being movable in the casing between two positions, the means holding the base in a first position in which the base moves away from the lower end of the casing, said means being unlockable by means of the cable connected to the surface, and the base may be placed in either of the two positions to effect opening or closing of the control element and possibly to effect movement of the set of instruments relative to the casing.

When the set of instruments is connected by the electric link to an electrical connecting element and when the cable connected to the surface has at least one transmission line, the method according to the invention may comprise the following steps:

(l) the set of instruments is equipped with a connecting electrical plug pluggable in a liquid medium,
(m) the set is placed at the end of the casing and the connecting element is placed in a position allowing connection with a complementary element connected to the cable connected to the surface and coming from the upper end of the casing, then
(n) a transmission cable equipped with the complementary electrical connection element designed to connect to the connecting element connected to the instrument set is introduced into the casing.

The control element may be electrical and it may be commanded by a cable connected to the surface.

The invention also furnishes a device allowing measurements and/or interventions to be made in a well in which hydraulic compression such as hydraulic fracturing is effected in a first zone and in which meaaurements and/or interventions are carried out in a second zone, involving casing with a diameter less than that of the well, a set of one or more instruments attached to a cable connected to the surface, the instrument set being mechanically uncoupled from the casing by an elastic link such as link cable. This device is characterized in particular by also having an element able to control circulation of fluid between the casing and the compression zone and by the cable being designed to command the element from the surface.

The device may comprise a casing, two annular sealing elements cooperating with said casing and the wall of the well to delimit the compression zone, a set of at least one instrument connected by an elastic link to a shaft integral with a base connected to the surface by a cable, the shaft being translationally displaceable and cooperating with isolating means integral with the casing to prevent the fluid contained in the casing from escaping therefrom via the lower end of this casing, an element located in the vicinity of the lower part of the casing [latter phrase is grammatically unrelated to sentence—translator].

When the first compression zone is the same as the second measuring and/or intervention zone, the device may have an expandable annular sealing element surrounding the casing at its lower part.

The casing may have, at its lower end, a protective housing which may accommodate the instrument set and the device may have a control element allowing the fluid to circulate through the element when a controlled pull is exerted on the cable, and the device may have a support-piece or base, movable in the casing, placed on the pull cable and designed to kiip the set in the housing when said piece is in the first position, and allowing the set to exit the housing and be removed from the casing, and preventing any circulation of fluid between the casing and the compression zone, when the support-piece is in a second position.

The end of the cable may have an anchoring system designed to cooperate with holding elements integral with the base.

The control element may have a stopper integral with the base or said shaft cooperating with a seat integral with the casing and the base may be moved to maneuver the control element.

Figure 2:
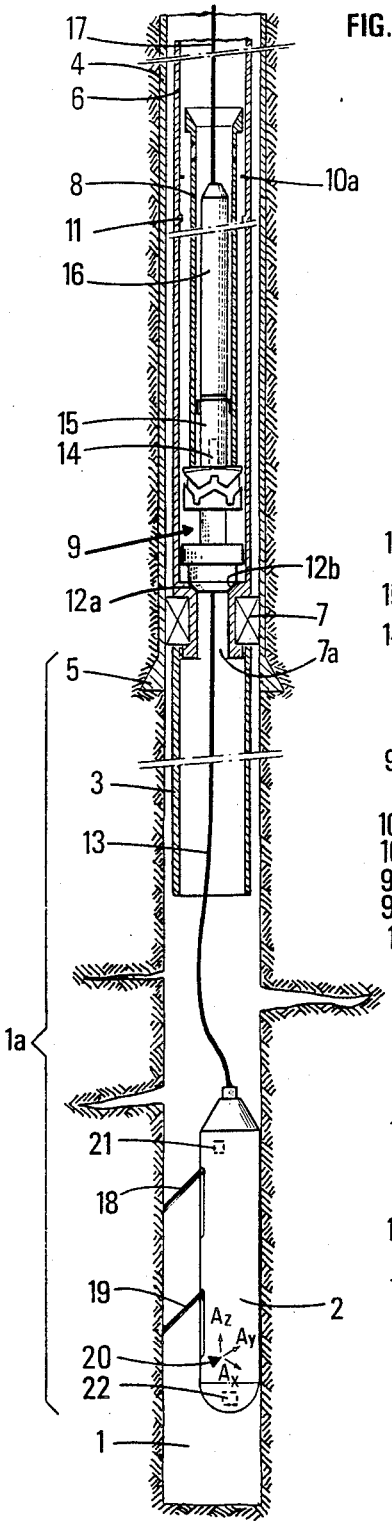
Figure 3C:
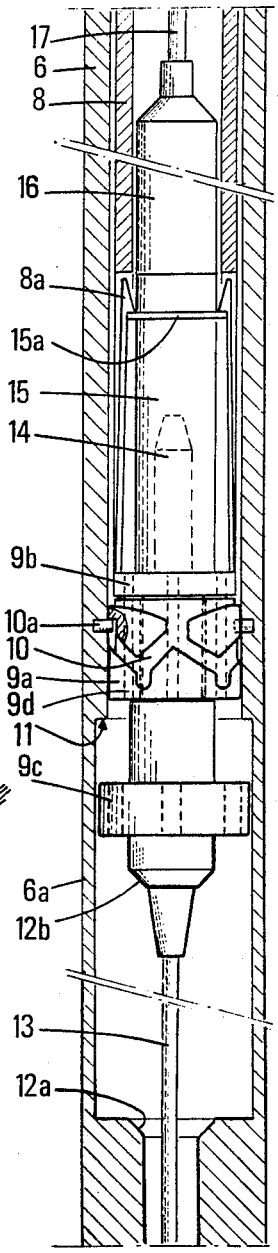
Figure 3A:
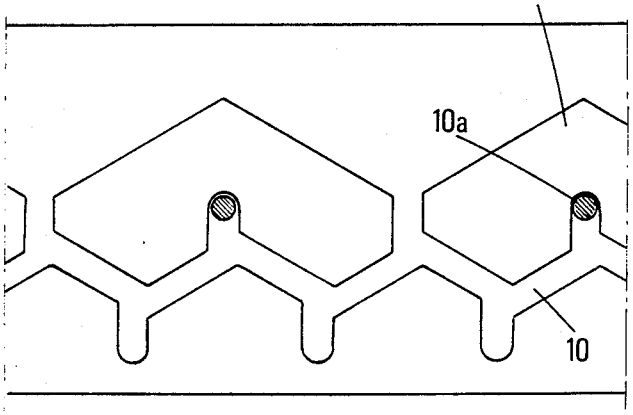
Figure 3B:
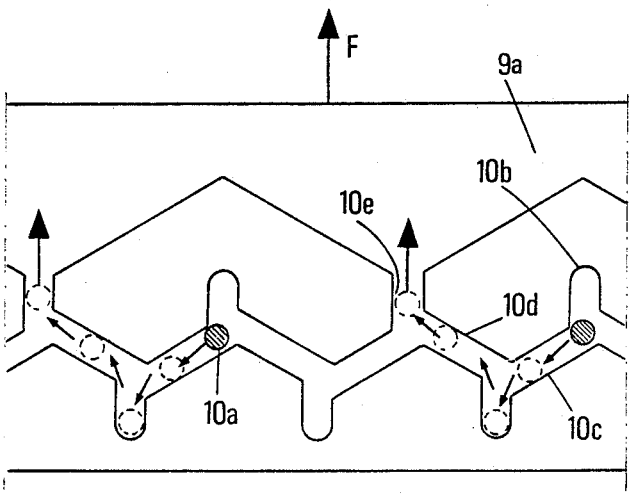
Figure 9:
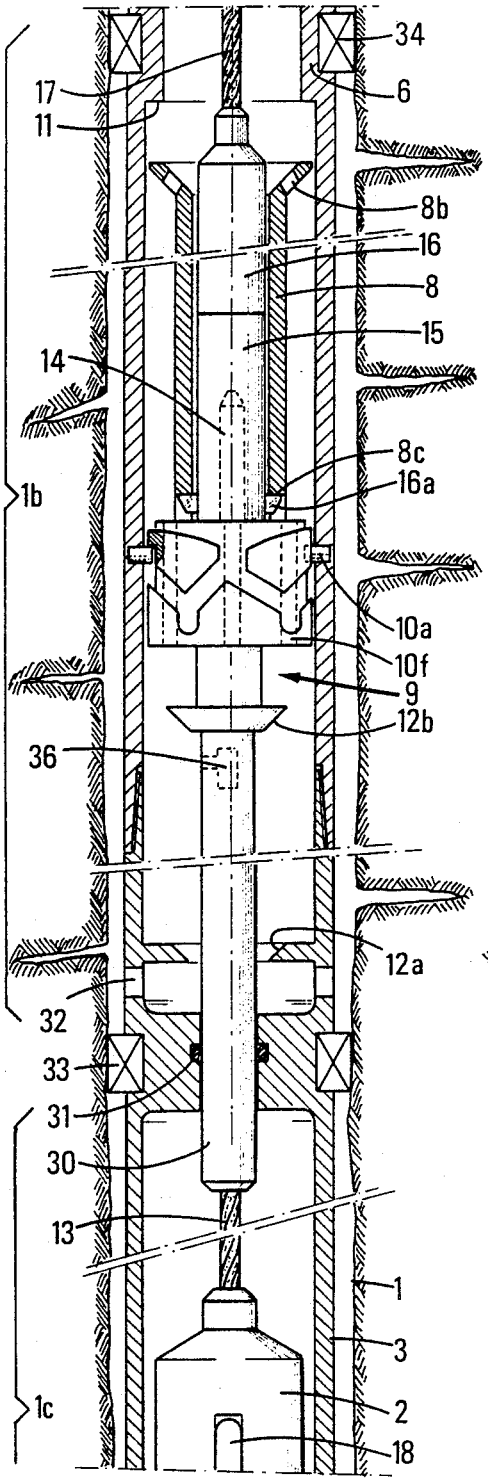
Figure 10:
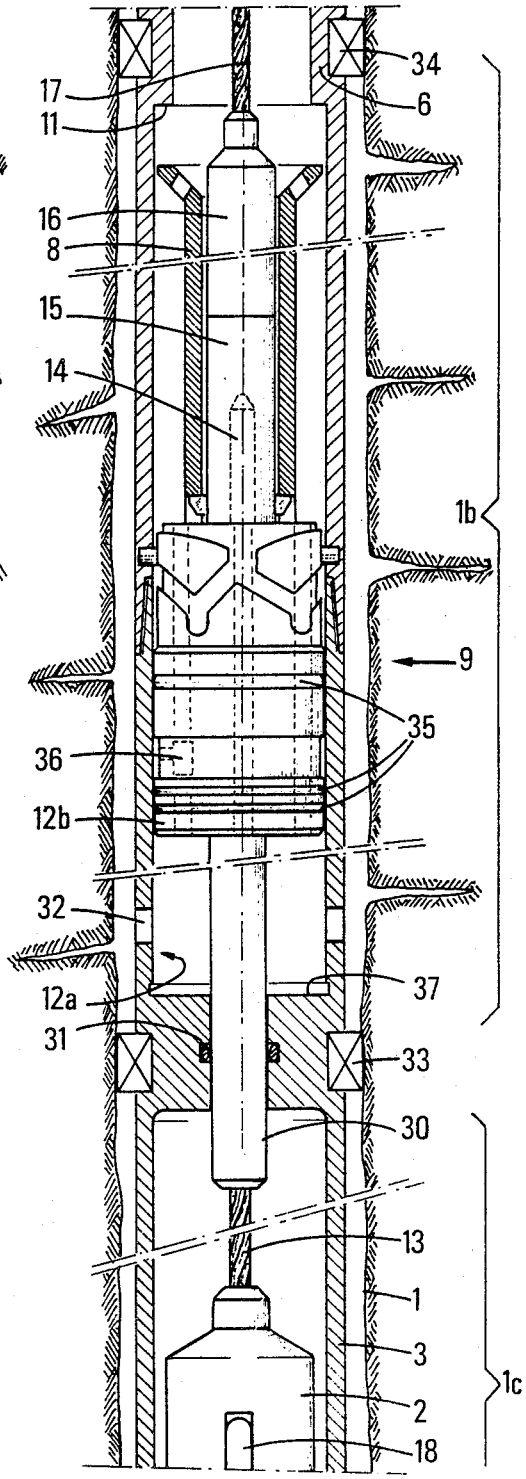

The present invention will be understood and its advantages will become evident from the following description, illustrated by the accompanying drawings wherein:

FIGS. 1 and 2 illustrate the initial position and a working position, respectively, of a device according to the invention lowered into a well passing through geological formations, FIGS. 3A and 3B show schematically in an enlarged view the anchoring system for the support-piece, in the locked position of the support-piece and during unlocking of the support-piece, FIG. 3C is a detailed view of the device near the element controlling fluid circulation between the casing and the compression zone, FIGS. 4 to 8 illustrate the various phases of implementing the device according to the invention, FIGS. 9 and 10 illustrate another embodiment of the device according to the invention used when hydraulic compresion is to be effected in one zone of the well and measurements and/or interventions in another zone.

FIGS. 1 and 2 correspond, respectively, to the initial position of a device according to the invention, lowered into a parrtially cased well 1, and the working position of this device, wherein probe 2 has been brought out of its protective housing 3.

Well 1 is equipped over a certain length with a casing 4 ending in shoe 5 at its lower part.

The device as shown in FIGS. 1 and 2 has at its lower part protective housing 3 in which the measuring and intervention set 2 is at least partially accommodated and which is surmounted by a casing 6 to which this housing is connected.

It will be considered in the following, as an example, that the set of one or more instruments 2 comprises a well-logging probe, but it could also comprise a television camera or an intervention instrument such as a drilling tool, etc.

An annular sealing element 7, radially expandabale, which may be of a classical packer type, is interposed between housing 3 and casing 6. All suitable safety means known to the individual skilled in the art may be used when sealing element 7 is positioned such that jamming of this element 7 will not interfere with the raising of instrument set 2.

Radial expansion of the sealing element element is obtained for example by axial displacement of casing 6, causing the packer's anchoring wedges to spread. A hydraulically anchored packer of a known type, for example Model AD1 by the Baker Oil Tools Company, may also be used.

In its expanded position, element 7 is pressed against the wall of casing 4. Housing 3 and casing 6 are both open at their ends.

A tubular centering guide 8 is accommodated in casing 6, said tubular guide being open at its upper part and having at its lower part a support-piece or base 9 equipped with an anchoring system 8*a*.

The set of instruments 2 is connected to base 9 by a flexible elastic link, i.e. a link with negligible stiffness which, in the embodiment shown, has a link cable 13 passing through an axial passage 7*a* in element 7 and having a length such that, in the upper position of base 9 (FIG. 1), probe 2 is at least partially accommodated inside its protective housing 3, while in the lower position of base 9, probe 2 is lowered from housing 3 (working position shown in FIG. 2).

In this way, instrument set 2 is mechanically uncoupled from the casing and the vibrations of casing 4 are not transmitted to the instrument set.

Cable 13 contains electrical power and measurement-transmission conductors which electrically connect probe 2 to a male multi-contact electrical plug 14 disposed on base 9. This male plug is designed to receive a matching female socket 15 surmounted by a loading or ballast bar 16.

An anchoring system, either mechanical having, for example, shearable washers adapted to socket 15 and cooperating with holding elements integral with tube 8, or electrohydraulic (having for example anchoring wedges activated by a remote-controlled motor) provide a mechanical link between bar 16 and base 9 when the electrical contact is made between plug 14 and socket 15.

The assembly formed by socket 15 and loading bar 16 is fastened to the lower end of a pull cable 17 containing electrical conductors for power supply and transmision of the measurements made by probe 2. This cable may in addition contain conductors for controlling certain elements such as the holding element when control is electrohydraulic, or carrying the transmission signals furnished by various sensors.

Examples of electrical connector usable for constituting the assembly plug 14 plus socket 15 are described in U.S. Pat. No. 4,500,155.

The probe may, for example, be of a known type and have, as anchoring means, articulated anchoring arms 18, 19 folding along the probe body when this probe is accommodated in the protective housing (FIG. 1), these arms being deployed hydraulically by electrical remote control from the surface via cables 17 and 13 when probe 2 is outside housing 3, in the working position shown in FIG. 2, whereupon arms 18 and 19 become anchored in the well wall and apply probe 2 against this wall on the diametrically opposite side (FIG. 2).

These arms may be connected to one or more skids applied against the well wall.

In one embodiment where probe 2 is used to detect and record the acoustic signals produced by geological formations fissured by hydraulic fracturing, this probe may in particular have triaxial dynamic accelerometers 20, recording the components $A_x$, $A_y$, and $A_z$ of the sound along three mutually perpendicular axes.

This probe may also have a hydrophone recording the compression waves of the fluid contained in the hole, and as shown in FIG. 2, pressure sensors 21 and 22, respectively, measuring the hydrostatic pressure prevailing in the well outside the probe and the pressure with which arms 18 and 19 are applied against the wall.

This probe may also have sensors determining, in known fashion:

its inclination to the vertical as well as the angle formed by a marker generatrix of this probe with a vertical plane passing through the probe axis (tool face) by means of triaxial static accelerometers or inclinometers.

The orientation of the probe with respect to magnetic north, i.e. the angle the vertical plane passing through the probe axis makes with the vertical plane containing magnetic north (by means of triaxial magnetometers or a compass).

When the probe is quasi-vertical, only the angle between the vertical plane containing the probe axis and the marker generatrix and the vertical plane containing magnetic north will be considered, using triaxial dynamic magnetometers or a compass.

In the above example, the base or support-piece 9 having a centering guide 8 is provided with all-mechanical holding means including a groove 10 cooperating with retaining pins 10*a*. This system allows the support-piece to be held in a first position, shown in FIG. 2, where the lower part of base 9 is located below an upper stop which may be formed by an internal shoulder 11 of casing 6 (FIG. 3C) at a sufficient distance therefrom for the anchoring system to be unlocked by raising base 9 (see below).

When groove 10 is disengaged from retaining pins 10*a*, as shown in FIG. 2 the support-piece 9 may move into a second position, or lower position, under the effect of gravity or hydraulic pumping. In the lower position, a stopper 12*b* placed at the lower end of support-piece 9 cooperates with a seat 12*a* integral with the casing such as to prevent any circulation of fluid.

A flow control element comprising 12*b* and seat 12*a* allows the circulation of fluid through the casing at the level of said element to be controlled.

Support-piece 9 as well as internal shoulder 11 has openings or bores allowing a hydraulic fluid to flow all the way along casing 6 around centering guide 8 as long as stopper 12*b* is not cooperating with seat 12*a* to block casing 6.

As shown schematically in FIGS. 3A and 3B, an anchoring system may have a W-shaped groove 10 provided in the outer wall of base 9 of centering guide 8, said base 9 being able to revolve about a vertical axis with respect to casing 6.

In the upper position shown in FIGS. 3A and 3C, the upper edge of the summit of this groove is supported on a pin 10*a* integral with the internal wall of casing 6.

By slightly raising assembly 16-15-14-8-9 by a pull F exerted on cable 17 out of the position shown in FIG. 3A, notch 10*b* at the upper part of groove 10 is disengaged from pin 10*a*. Upper edge 10*c* of groove 10 then rests on this pin, causing rotation of base 9 which brings upper edge 10*d* of groove 10 opposite the pin. By easing off on pull F, edge 10*d* comes to rest on pin 10*a*, urging base 9 rotationally until it is disengaged from pin 10*a* [when the latter passes] through opening 10*e* (FIG. 3B).

The aforesaid assembly can then descend by gravity to its lower position shown in FIG. 2.

Instead of the all-mechanical anchoring system described above, base 9 may have an electrohydraulic anchoring system remote-controlled from the surface.

With this arrangement, the clearance between support-piece 9 and shoulder 11 may be reconsidered, since the clearance necessary to release pin 10*a* from the W-shaped groove no longer has any function.

Figure 4:
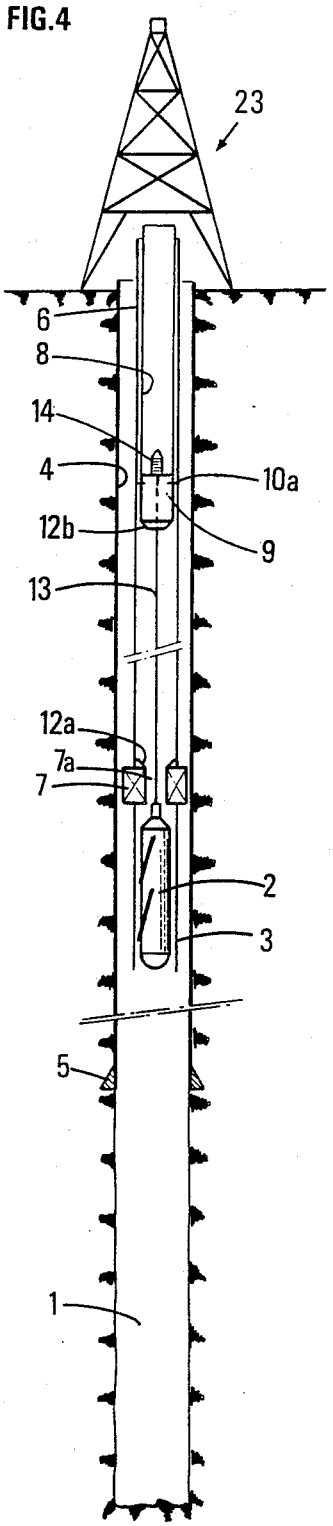

Implementation of this device is indicated below with reference to FIGS. 4 to 8 which show the successive stages of this technique. FIG. 4 illustrates the first stage in which, first of all, packer 7 is fastened to the lower end of casing 6 at the surface.

Base or support-piece 9 provided with centering guide 8 which is placed in the upper or first position (FIG. 1) is then introduced into the casing, disposed vertically, with base 9 resting on pins 10*a* by means of anchoring groove 10, causing the link cable containing electrical conductors 13 to pass through packer 7, the link cable being previously connected to base 9.

In other embodiments of the device according to the invention, instead of locating packer 7 between the lower end of casing 6 and protective housing 3, protective housing 3 may be eliminated, or packer 7 may be place above the lower end of the casing, for example above the level of the upper end of centering guide 8 when the latter is in its topmost position.

Probe (or intervention tool) 2 is then attached beneath packer 7 at the lower end of link cable 13 and is thus suspended from pins 10*a* in the upper position shown in FIG. 1. Then, the protective housing of the probe which is accommodated inside the housing is attached to the lower end of packer 7.

Figure 5:
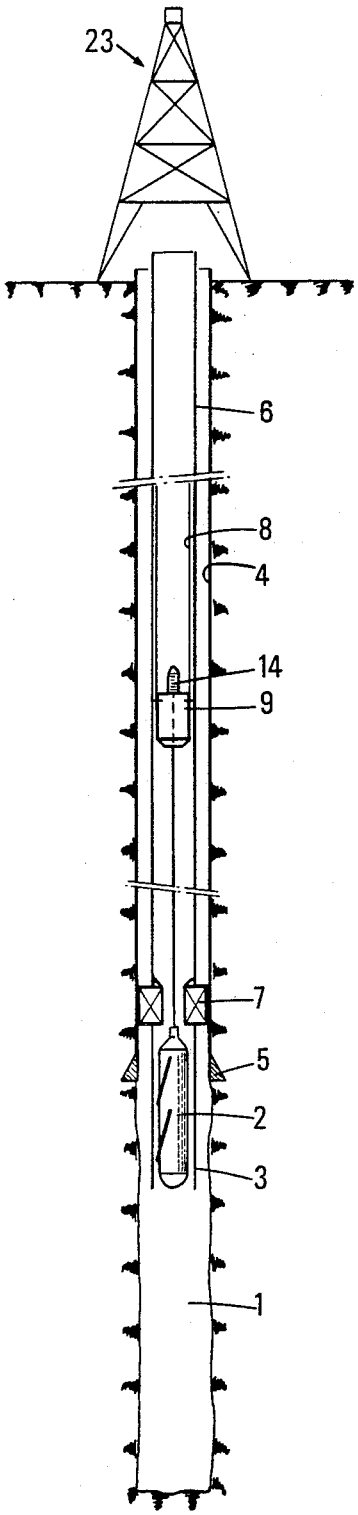

The assembly or set is then steadily lowered into well 1 (FIG. 4) from derrick 23, adding successive casing elements 6 until probe 2 reaches the desired depth, for example essentially at the level of shoe 5, with the number of casing elements 6 connected end to end giving information at all times on the depth reached. When this position is reached, packer 7 is anchored to the lower end of casing 4 (FIG. 5).

Casing 6 is connected at its upper part of a pressurized hydraulic fluid feed line 24 and is fitted at its top with a safety stopper or stuffing box 25 through which pull cable 17 slides, said cable holding loading bar 16 and female socket 15 until the latter is connected to male plug 14 attached to base 9 of centering guide 8 having for example a tubular element which supports the probe, with centering guide 8 providing guidance for assembly 15-16 to facilitate this connection.

Locking or mechanical linkage elements 15*a* and 8*a* are adapted to socket 15 and the inner wall of tube 8, respectively.

In the example considered, elements 15*a* and 8*a* are composed respectively of a shearable washer mounted on socket 15 or loading bar 16 and arms or knives for holding this washer, mounted on tubular guide 8. These elements 15*a* and 8*a* are designed to be disengaged from each other by a sufficient tug exerted on cable 17 from the surface.

Any other type of known means controlled from a distance such as electric or electrohydraulic dogs allowing loading bar 16 to be attached to support-piece 9 can be used.

Figure 6:
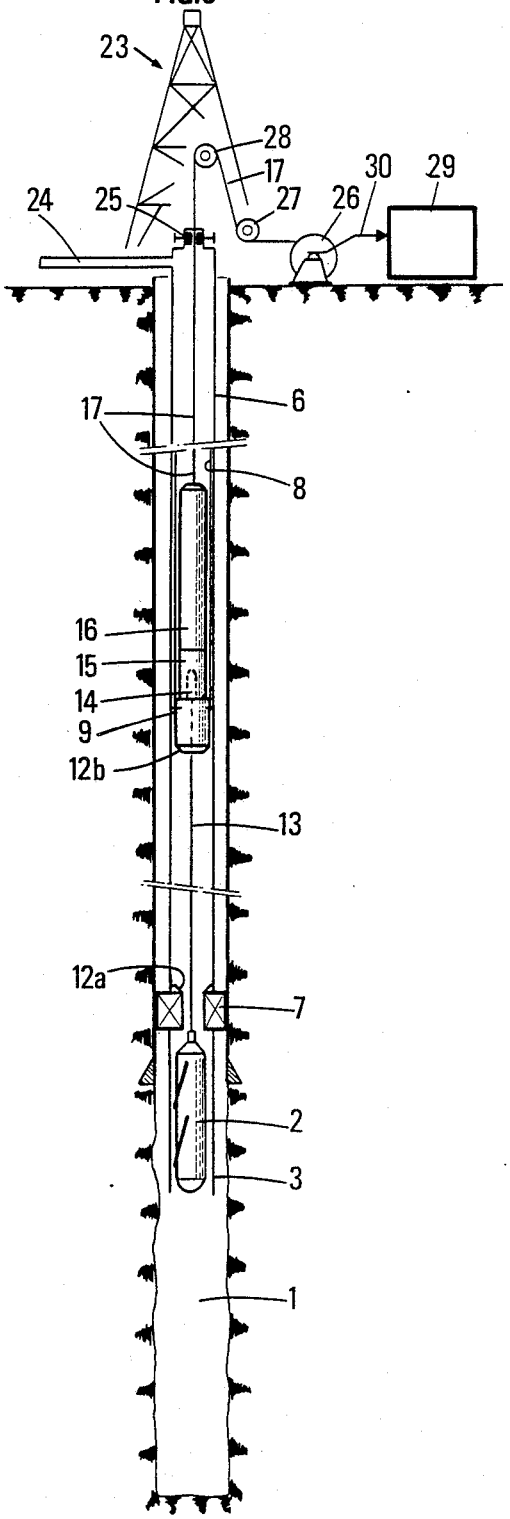
Figure 7:
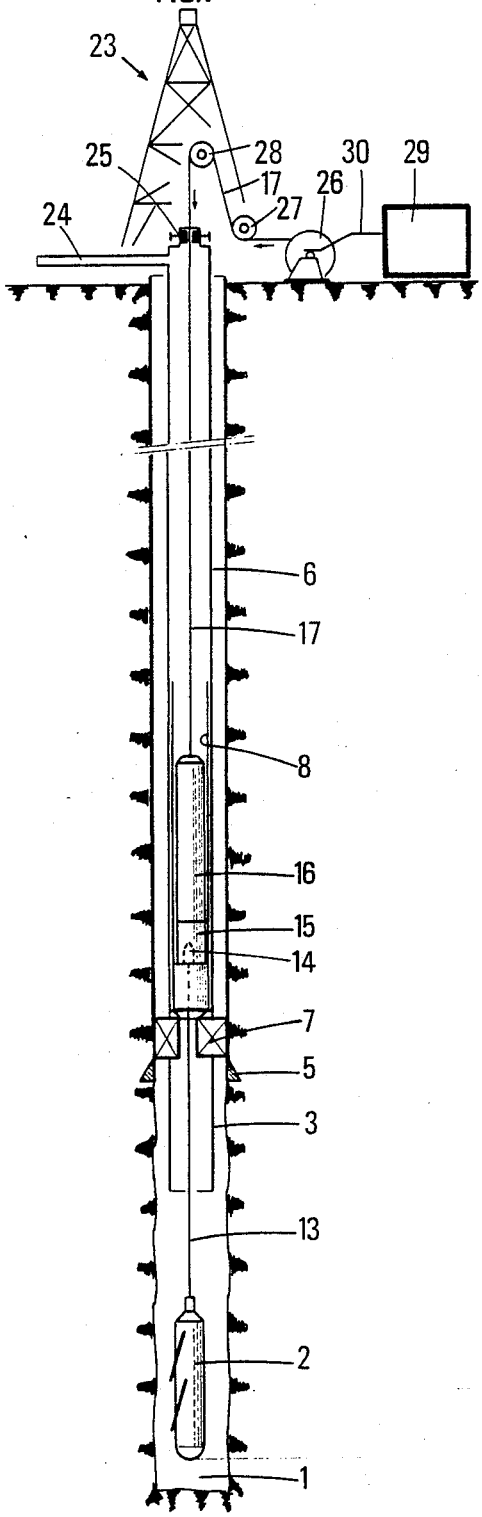
Figure 8:
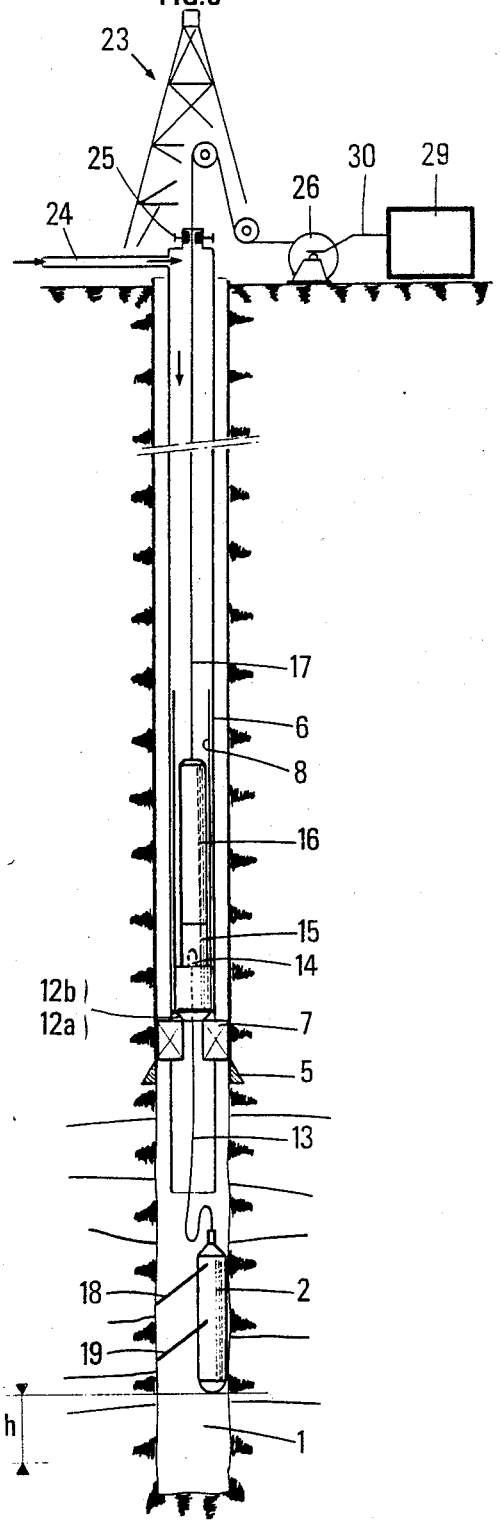

Cable 17 is paid out from the surface by a winch 26. Between winch 26 and stopper 25, cable 17 passes over return pulleys 27 and 28 (FIG. 6).

When the operations of electrically connecting socket 15 with plug 14 and mechanically linking bar 16 and base 9 are accomplished, while base 9 is held in the upper position:

hydraulic fluid is pumped under pressure through line 24 located at the surface such as to subject zone 1*a* located beneath packer 7 to hydraulic compression with a view to fracturing. The pumped fluid circulates through casing 6 around centering guide 8 (orifices 8*b* of the guide being positioned to facilitate transfer of fluid between the inside and outside of the guide), through base 9 via pipes 9*d* at the level of the W-shaped groove and pipes 9*c* on the part of the base cooperating with shoulder 11, before passing through seat 12*a*.

A slight tug F is then given to cable 17 (FIG. 3B) which detaches pin 10*a* from base 9 of tubular element 8 which then assumes the lower position corresponding to FIG. 2, probe 2 being lowered from its protective housing 3 and then being in the lower uncased or bare part of well 1 (FIG. 7), stopper 12*b* then being in a position allowing it to cooperate with seat 12*a* ensure isolation of the fracturing zone.

Centering guide 8 is then lifted slightly followed by probe 2 itself to a height h (insufficient to cause it to go back into its housing 3) by a tug on cable 17 and, in this position of the probe (FIG. 8) the opening of articulated arms 18 and 19 is remote-controlled from station 29 by means of cables 17 and 13. The ends of these arms become anchored in the wall of well 1 when probe 2 is pressed against the portion of wall diametrically opposite these arms.

The pull exerted on cable 17 from the surface is eased and support 9 falls back into its bottom position under the influence of gravity. This has the effect of conferring some slack on cable 13, which is thus released (FIG. 8) and of applying 12*b* against seat 12*a* with which it cooperates to prevent any circulation of fluid between the casing and the zone to be compressed.

Stopper 12*b* is held on seat 12*a*, providing the proper hydraulic pressure differential between the inside of the casing and the zone to be fractured such that isolation of the zone to be fractured is effective. For this purpose one may for example either advantageously place and maintain the casing under a constant pressure greater than that of the zone, or control in the course of time the casing pressure such that its value remains higher than that of the fracturing zone and stopper 12*b* is still applied to seat 12*a*.

The order of the operations of pumping, installaltion, and anchoring of probe 2 may be reversed. However, the proposed procedure is safer since, in the course of pumping, while base 9 is held by pin 10*a* cooperating with the W-shaped groove in the upper position, there is no risk of stopper 12*b* suddenly stoppering the control element. This sudden stoppering upon pumping would produce a water hammer, with damaging consequences.

The device according to the invention described hereinabove allows said instrument set 2 to be protected from the virbrations of said casing 6 when measurements or interventions are being carried out. The means permitting this comprise a combination of elements 18, 19 for anchoring said instrument set 2 to a fixed level of well, said means being activated by remote control, and a flexible link 13 between said instrument set 2 and a support-piece 9 displaceable in casing 6 between a position near upper top 11 and a position near lower stop 12 which positions define the first and second positions, respectively, of said instrument set 2.

The signals for remote control of probe 2 from the surface as well as the measurement signals from probe 2 and the electric current supplying it are transmitted from and to surface station 29 by conductors incorporated in cables 13 and 17, respectively, the electric link between these conductors and station 29 being provided in known fashion by a set of brushes rubbing collector rings integral with the shaft of winch 26.

When the various measuring operations have been completed:

- the casing is decompressed so that stopper **12*b* is no longer applied against 12*a*;**
- closing of articulated arms 13 and 19 is remote-controlled from the surface;
- probe 2 is brought into its protective housing 3 by pulling on cable 17 restoring base 9 of centering guide 8 to the upper position of FIG. 1 in which this base is held by pin **10*a*. Engagement of groove 10 and pins 10*a* is effected in a manner analogous to that described above with reference to FIGS. 3A and 3**B.
- Although the geological formations have already been decompressed alowly by reducing the pressure in line 24, as soon as stopper **12*b* no longer cooperates with seat 12*a* to prevent any circulation of fluid, this decompression can be effected only when probe 2 has been brought into its protective housing 3**.

According to the invention, the zone to be fractured can be pressurized in steps by opening control element **12*a*, 12*b* by depressurizing casing 6, then by raising stopper 12*b* before pumping again and closing control element 12*a*, 12*b***.

A sufficient pull on cable 17 shears washer **15*a* and then disconnects female electric socket 15 from male plug 14, whereby base 9 comes to rest against upper stop 11, and by means of cable 17 the assembly composed of female socket 15 and loading bar 16** surmounting this socket can be raised.

The assembly 2, 8, 9, 13, **12*b* remains suspended from retaining pins 10*a* integral with casing 6 by means of the W-shaped anchoring system designated 10**.

Casing 6 then in turn be gradually hauled out of the well, with the elements of this casing being successively disconnected at the surface.

One embodiment has been described above as an example according to which annular sealing element 7 is disposed beneath base 9. This embodiment has the advantage of positioning element 7 in the immediate vicinity of shoe 5 and limiting the uncovered length between the base of this shoe and the bottom.

It would not, however, be a departure from the scope of the invention to position equipment assembly 8, 9 at a level lower than that of sealing element 7 whose axial passage **7*a* would then be traversed by transmission cable 17**. The latter embodiment has the following advantages:

- the mechanical assembly located beneath packer 7 is at the same pressure as the compressed hydraulic fluid below this packer,
- it is possible to provide openings for fluid flow in casing 6 below the level of element 7 between the latter and the level of upper stop 11.

Other means of implementing the equipment defined above are also possible.

It would, for example, be possible to place sealing element 7 in an uncased zone of the well which would be isolated from the rest of the well by the use of a sealing element completely sealing off the well at a level lower than that of the instrument or probe in its bottom position.

According to one version of the latter embodiment, casing 4 is lowered under the total sealing element defined above. In the zone delimited by the two sealing elelments, casing 4 is perforated in classical fashion to permit the hydraulic fluid injected to flow through the formations located at this level.

When the entire device is under hydraulic pressure, probe 2 may be moved simply by pulling on cable 17 from the surface, after remote-controlling the closing of arms 18 and 19.

When the technique described hereinabove is applied to highly deflected or horizontal wells, instrument or probe 2 may be withdrawn from housing 3 by pumping hydraulic fluid, then possibly moving casing 6 from the surface to slacken the tension in cable 13 before carrying out the measurement or intervention by means of the probe or instrument 2.

The description of the invention illustrated in FIGS. 1 to 8 uses, as an element for controlling circulation of fluid between the casing and the zone to be compressed, an element having a stopper integral with the pulling cable cooperating with a seat integral with the casing and said element is designed to permit any fluid to circulate once a tug is exerted on the stopper via the cable.

It will not be a departure from the scope of the present invention to use any other control element maneuverable by a cable, particularly an element having a stopper integral with the pull cable cooperating with a seat integral with the casing, said element preventing any circulation of fluid through it when an appropriate pull is exerted on said stopper, the probe being placed below the stopper.

Such an arrangement offers the twin advantage, while the fracturing zone is under pressure:

- of not pressurizing the casing and not applying the stopper against the seat by pulling on the cable since the pressure in said zone has the effect of naturally closing said element once the stopper has been applied against the seat,
- of being able to repressurize the zone to be fractured, in a very simple manner.

The latter device, however, has the disadvantage of being more complex in use than that illustrated in FIGS. 1 to 8 when the probe is slid, leading to an undesired tension in the link cable.

In the first device described, to de-anchor the probe from the well, after opening the control element, one need only pull on cable 17 to raise the probe, then re-anchor it before slackening the cable while for the latter device described it is necessary to move the packers aside and produce a movement in the casing to slacken the link cable.

When the cross sections of the passageways permit, particularly at right angles to packer 7 and seat 12*a*, the first device described also has the advantage of allowing instrument set 2, stopper 12*b*, and the pull cable to slide along casing 6 so that the loading bar, the W-shaped groove, and the centering guide can be eliminated.

According to another embodiment of the invention shown in FIG. 9, probe 2 is located in a zone 1*c* of the well in which no fracturing occurs. Fracturing is effected in a zone 1*b* delimited by two sealing elements 33 and 34 which, in the example of FIG. 9, are supported by casing 6.

Cable 17, which is connected to the surface, is terminated at its lower end by an electrical connecting element 15 surmounted by a loading bar 16 allowing the cable to be lowered into said casing.

Loading or ballast bar 16 is centered on base 9 by means of guide 8, then anchored thereto. The means permitting anchoring may include, for example, electric or electrohydraulic dogs 16*c* integral with loading bar 16 and controlled from the surface cooperating with notches 8*a* in the body of guide 8 or base 9. It is also possible to use the mchanical anchoring means described and illustrated in the first embodiment according to the invention.

Connecting element 15 which is a female socket cooperates with a matching connecting element 14 which is a male plug integral with base 9 and connected to probe 2 or to the elements and instruments which are to be connected to the surface.

This second embodiment of the device according to the invention is distinguished from the first in that between base 9 and flexible link cable 13 is interposed a rigid shaft 30 integral with base 9, said shaft being translationally displaceable and cooperating with isolation means 31 integral with casing 6 to prevent the fluid contained in the casing from escaping through its lower end. The isolation may be effected with an O-ring placed in a groove and cooperating with a smooth outer surface of said shaft 30.

The device has an element 12*a*, 12*b* controlling the circulation of fluid from the casing and going to the zone to be compressed with a view to its hydraulic fracturing, through one or more passageways 32 provided in casing 6.

Control element 12*a*, 12*b* of FIG. 9 comprises a stopper 12*b* which is integral with base 9 of said shaft 30 and cooperates with a seat 12*a* integral with casing 6.

The travel of base 9 is limited in the upper position by the play of retaining pin 10*a* in W-shaped groove 10 and in the lower position by the contact of stopper 12*b* on seat 12*a*.

The travel of the base can be limited in its upper position, particularly when anchoring system 16*a*, 8*c* of the loading bar at the base is moved aside by pulling on cable 17, by means of a stop 11 placed above centering guide 8 at a sufficient distance to allow pin 10*a* to move in W-shaped groove 10. This arrangement prevents deterioration of pin 10*a* and groove 10 when the anchoring means are sheared.

In FIG. 9, probe 2 is held in a protective housing 3 placed at the lower end of casing 6. By elongating housing 3 or interposing tubular elements between casing 6 and housing 3, and adapting the length of link cable 13, one may carry out measurements and/or interventions at a point remote from the compression zone.

The travel of the base inside the casing as well as shaft 30 are designed so that enough space can be provided between the probe or instrument assembly and the protective housing for the measurements and/or interventions to be carried out.

To bring about circulation of fluid to control element 12*a*, 12*b*, various passageways 8*b*, 10*f* respectively are provided through the flared part of centering guide 8 [and] the body of W-shaped groove 10.

In FIG. 9, link cable 13 is attached to the lower end of shaft 30, but shaft 30 may have a hollow part resistant to compressive pressure in which the link cable is attached. The particular purpose of this is to increase the length of link cable 13 and hence its flexibility.

To measure the fracturing pressure of zone 1*b*, one may place a pressure sensor 36 on shaft 30 directly connected to the electric lines connected to the surface.

The device described above is implemented as follows:

(a) the assembly composed of casing 6, sealing elements 33 and 34, probe support 9, centering guide 8, control element 12*a*, 12*b*, shaft 30, link cable 13, probe 2, and protective housing 3 is lowered into the well. The base is held in the upper position by cooperating with pin 10*a* and W-shaped groove 10, the probe being protected by housing 3, (b) the sealing elements are positioned, (c) a connector 15, 16 connected to cable 17 is lowered from the surface, whereby the connector cooperates with base 9 such as to ensure an electrical and mechanical link, (d) zone 1*b* to be fractured is compressed, (e) base 9 is lowered bymeans of cable 17 connected to the surface until probe 2 has reached its anchoring position and has been lowered from the protective housing, (f) the probe is anchored, (g) lowering of base 9 is continued until stopper 12*b* comes to abut seat 12*a*, with the link cable between shaft 30 and probe 2 slackened, (h) stopper 12*b* is held on seat 12*a*, producing sufficient pressure in the casing, and (i) the measurements and/or interventions are carried out.

The order of certain steps could be reversed; however, as mentioned in the description of the first embodiment, it is better to compress the zone when base 9 is in the upper position rather than anchoring probe 2 before hydraulic compression.

When sealing elements 33, 34 are of the hydraulic anchoring type, the control element can be stoppered and the casing pressurized to set these elements in position. For this purpose, the hydraulic link allowing element 34 to be activated must terminate at a level higher than that of sealing element 12*a*, 12*b*, i.e. at a point in the casing which can be pressurized without the zone to be fractured being pressurized.

For recompression of the zone to be fractured, of desired, to release the pressure in the casing one need only separate stopper 12*b* from seat 12*a* by a sufficient distance, which may or may not involve lifting probe 2, to recompress the zone to be fractured, possibly to replace the probe, to place stopper 12*b* in contact, to ensure pressure in the casing to keep 12*a* and 12*b* in contact.

According to this embodiment of the invention, the system is essentially pressure-balanced since the pressure forces of the fracturing fluid are applied to the two sealing elements 33, 34 in opposite directions and hence casing 6 is not subjected to a vertical force due to the pressure forces of the fracturing fluid.

This embodiment allows probe 2 to be displaced after anchoring sealing elements 33, 34 even during compression. For this reason, anchoring elements 8c, 16a and holding means 10, 10a must permit transmission of a sufficient tractive effort to overcome the action of the pressure forces acting on the straight section of shaft 30.

This embodiment of the invention could also be used when it is desired to carry out measurements and/or interventions in the compression zone. For this purpose, one need only eliminate the lower seal produced by annular element 33 of the packer type.

FIG. 10 illustrates one version of the embodiment according to the invention illustrated in FIG. 9 and is distinguished from the foregoing in that the element controlling fluid circulation is of a sliding type attached to the periphery of support 9, by the stop of the base being adapted as a consequence, and by the sensor sensing fluid pressure in the compression zone not being mounted on the shaft.

The control element has a stopper 12b having a sliding jacket at the ends of which are placed seals 35 such as O-rings, and has a seat 12a provided in the internal wall of casing 6. The seat has an orifice 32 through which the fluid flows to the zone to be compressed.

Seat 12a is designed to cooperate with stopper 12b to ensure a seal between the inside of the casing and the zone to be compressed, when support 9 is sufficiently low for jacket 12a [sic] to stopper orifice 32. The second position, or lower position, of the support is achieved when one of the ends of jacket 12b has reached bottom 37 of the casing, while stopper 12b cooperates with seat 12a to prevent any circulation of fluid through orifice 32.

Instead of the jacket itself being applied to the bottom 37 of the casing, it is possible to place on this bottom a stop cooperating with base 9 or shaft 30 to ensure the same effect.

Pressure sensor 36 is located in stopper 12b at a level such that it is hydraulically connected with the compressed zone when the stopper is in place. A groove 38 going all the way around stopper 12b and in which sensor 36 is located allows it to be linked with compression zone 1b whatever the indexing of the support with respect to the casing.

It will not be a departure from the present invention to dispense with casing 6 of protective housing 3. In this case, the travel of base 9 could be limited.

To control the circulation of fluid between the compression zone and the casing, an electric element remote-controlled by the cable connected to the surface can be used. This offers in particular the advantage of uncoupling the command of the element controlling movement of support 9 when it is desired to move probe 2.

I Claim:

1. A method for carrying out measurements and/or interventions in a well having a first zone where hydraulic compression including hydraulic fracturing is effected and a second zone where the measurements and/or interventions are carried out, wherein a set on one or more measurement and/or intervention instruments is lowered into said well at the lower end of a casing, said compression zone being connected by the casing to hydraulic pressurization means, said set being connected to the surface by a cable located inside the casing and being mechanically isolated from the casing by an elastic link, characterized by controlling, at a point in the casing near said fracturing zone, any flow of fracturing fluid coming from or going to said fracturing zone, by means of a control element commanded at least partially by said cable from the surface, said control element being located at a level higher than said set and said fracturing fluid passing through said control element before reaching the fracturing zone.

2. A method according to claim 1, wherein said first compression zone and said second measurement and/or intervention zone are the same, and are located at the lower end of the casing, characterized by the control element having a stopper integral with said cable connected to the surface and a seat integral with the casing, said stopper cooperating with said seat to ensure flow and non-flow of the fluid through said element, and by allowing circulation of the fluid through said element when a control pull is exerted on said stopper by said cable to cause the stopper to be spaced from said seat.

3. A method according to claim 1, wherein said first compression zone and said measurement and/or intervention zone are the same and are disposed at the lower end of the casing, characterized by the control element having a stopper integral with said cable connected to the surface and a seat integral with the casing, said stopper cooperating with said seat to ensure flow and absence of flow of the fluids through said element, and by preventing circulation of fluid through said element when a control pull is exerted on said stopper by said cable to cause the stopper to engage with said seat.

4. A method according to claim 1, wherein said first compression zone is isolated from said second measurement and/or intervention zone and said first compression zone is located between a lower end of said casing and the surface, characterized by the end of the cable having a base moveable translationally and connected to said set by a shaft, said shaft cooperating with isolating means integral with the casing to prevent the fluid contained in the casing from leaking out of the lower end of the casing, said control element having a stopper integral with said base or said shaft cooperating with a seat integral with the casing, and by moving said base by means of said cable to maneuver said control element.

5. A method according to claim 1, characterized by said control element being held in a position preventing any circulation of fluid, producing a controlled pressure differential between said casing and said zone to be fractured, or on either side of said element.

6. A method according to claim 1, characterized by said cable having at least one electric line and by said end of the cable having a connecting element connected to said line and adapted to cooperate with a matching connecting element integral with the base when said end of cable is anchored by said base, said matching connecting element being connected by at least one electric line to said instrument set and/or said control element.

7. A method according to claim 1, characterized by said set of instruments being moved relative to said casing by means of said cable.

8. A method according to claim 1, characterized by comprising the following steps to effect said measurements and/or interventions:

(a) said casing is placed in said well;

(b) said set of instruments is anchored to said measuring and/or intervention zone of said well;

(c) an elastic link is slackened;

(d) a hydraulic pressure is produced in said compression zone; and (e) said control element is stoppered.

9. A method according to claim 1, wherein a stopper of said control element permits any fluid to circulate when a controlled pull is exerted on said cable connected to the surface and wherein a seat of said control element has a sufficient cross section to allow said instrument set to pass therethrough, characterized by comprising the following steps:

(f) said casing is placed in said well;

(g) said instrument set is slid into said casing;

(h) said instrument set is anchored in said well at the level of said zone to be fractured;

(i) a connecting link is slackened;

(j) a hydraulic pressure is produced in said fracturing zone so as to ensure fracturing; and (k) said control element is stoppered.

10. A method according to claim 1, characterized by a lower end of the cable having retaining means including an anchoring system for cooperating with retaining elements integral with a base, said base being displaceable in a casing between two positions, said means holding said base in a first position in which said base moves away from the lower end of the casing, said means being unlockable by means of the cable connected to the surface and characterized by said base being placed in either or two positions to produce an opening or closing of said control element and to cause the set of instruments to move relative to said casing.

11. A method according to claim 1, wherein said instrument set is connected by an electric link to an electric connecting element and wherein said cable connected to the surface has at least one transmission line, characterized by comprising the following steps:

(l) said set of instruments is equipped with a connecting electrical plug pluggable with a liquid medium;

(m) said set is placed at the end of the casing and said connecting element is placed in a position allowing connection with a complementary element connected to said cable connected to the surface and coming from the upper end of the casing; and (n) a transmission cable equipped with said complementary electrical connecting element adapted to said connecting element connected to said instrument set is introduced into the casing.

12. A method according to claim 1, characterized by said control element being electrical and being commanded by electrical conductor means operatively associated with the cable connected to the surface.

13. A device allowing measurements and/or interventions to be made in a well wherein hydraulic compressions including hydraulic fracturing is effected in a first zone and wherein measurements and/or interventions are carried out in a second zone, said device having a casing with a smaller diameter than that of said well, a set of one or more instruments attached to a cable connectd to the surface, said instrument set being mechanically isolated from the casing by an elastic link, and a control element adapted to control circulatin of fluid between the casing and said compression zone; said cable being adapted to control said element from the surface and said control element being arranged within said casing so that fracturing fluid must pass through said control element before entering into said first zone to effect hydraulic fracturing.

* * * * *